US005394840A

United States Patent [19]

Phelps

[11] Patent Number: 5,394,840

[45] Date of Patent: Mar. 7, 1995

[54] FUEL SUPPLY SYSTEM

[76] Inventor: Harold E. Phelps, 432 Barns Rd., Winston-Salem, N.C. 27107

[21] Appl. No.: 260,307

[22] Filed: Jun. 15, 1994

Related U.S. Application Data

[63] Continuation-in-part of Ser. No. 89,483, Jul. 12, 1993, Pat. No. 5,341,776.

[51] Int. Cl.[6] ..... F02B 33/04

[52] U.S. Cl. ..... 123/73 C; 123/DIG. 5; 261/35; 261/41.1; 417/395

[58] Field of Search ..... 123/73 C, 387, DIG. 5; 261/35, 41.1, 41.5; 417/380, 395

*Primary Examiner*—Noah P. Kamen

*Attorney, Agent, or Firm*—Gifford, Krass, Groh, Sprinkle, Patmore, Anderson & Citkowski

[57] ABSTRACT

A closed loop fuel supply system for operating engines in all possible attitudes in which fuel is delivered by a vacuum pump responsive to the vacuum level in the crankcase of the engine and in which the vacuum driving the pump is modulated in response to the pressure of fuel being delivered to the fuel supply system so that the amount of fuel delivered for combustion purposes is equal to the requirements of the engine without any excess. In another embodiment, the delivery of pulsating fuel is dampened to obtain a uniform fuel delivery and distribution to the combustion chamber is under the control of three shutoff valves operating throughout the speed range of the engine. In each embodiment fuel is conserved and a fuel return line is not required.

11 Claims, 2 Drawing Sheets

FUEL SUPPLY SYSTEM

This is a continuation-in-part of copending application Ser. No. 08/089,483, filed on Jul. 12, 1993, U.S. Pat. No. 5,341,776.

This invention relates to a fuel supply system for small internal combustion engines.

In the operation of small internal combustion engines of the two cycle type which are used with a variety of portable powered tools such as chain saws, leaf blowers and the like, the carburetor must be very small and compact and be capable of operating in all positions of the engine.

Typically, with such two cycled engine fuel systems, little attention has been given to efficiency and the primary concern has been to insure sufficient fuel for operation in a wide range of engine speeds varying from 3000 to 8000 rpm. To insure sufficient fuel, it has been the practice to deliver fuel in proportion to the engine speed and to provide for a return of any excess fuel through a return system to the fuel tank. Most of such fuel arrangements are difficult to control particularly at low speeds when the fuel requirements are low. The problem becomes aggravated when the engine is operating at high speed and it is desired to reach low speed as rapidly as possible. For example, an engine used with a chain saw may operate at high speed to make a cut but when the cut is finished the operator will move the throttle to a closed or idle position and the delivery system must react very rapidly or fuel continues to be delivered in excess of the amount required for operation. This results in excess fuel being exhausted to the atmosphere and causes air pollution. In recognition of the pollution problems, various government agencies are making regulations relative to the content of exhaust gases from such engines.

It is an object of the present invention to provide a fuel delivery system in which fuel is delivered to the engine at the appropriate level required for operation throughout the full range of operating speeds.

Another object of the invention is to provide a fuel delivery system which responds to the fuel being consumed by the engine to regulate the pressure of fuel being delivered for ignition.

Yet another object of the invention is to provide a fuel delivery system which delivers the required amount of fuel to the engine for all levels of operation without requiring a return line to the reservoir.

SUMMARY OF THE INVENTION

The fuel supply system of the invention incorporates a housing with a mixing passage for supplying a mixture of fuel and air to the engine, a throttle valve disposed in the passage for controlling the supply of fuel and air mixture to the engine and a pump operating in response to vacuum pulsations in the crank case of the engine to receive fuel from a fuel reservoir and deliver that fuel to a metering system connected to the mixing passage The fuel control system is responsive to the pressure of fuel being delivered by the pump to the metering system to regulate the level of vacuum available to drive the fuel pump thereby controlling the output pressure of fuel from the pump to the fuel metering system so that fuel delivery is proportion to the vacuum level resulting from rotation of the engine.

In another embodiment of the invention, the pressure of fuel is dependent on engine speed and the pulsations of pumped fuel are dampened by another form of fuel control means interposed between the pump outlet and the fuel metering system. In both embodiments, the fuel required is delivered to the combustion chambers making it unnecessary to provide a return loop to the fuel tank. The arrangement further provides for shutting off the supply of fuel at any time the rotation of the engine stops.

The objects of the invention will become apparent from the following description and the drawings of a preferred embodiment in which.

DETAILED DESCRIPTION

Figure 1:
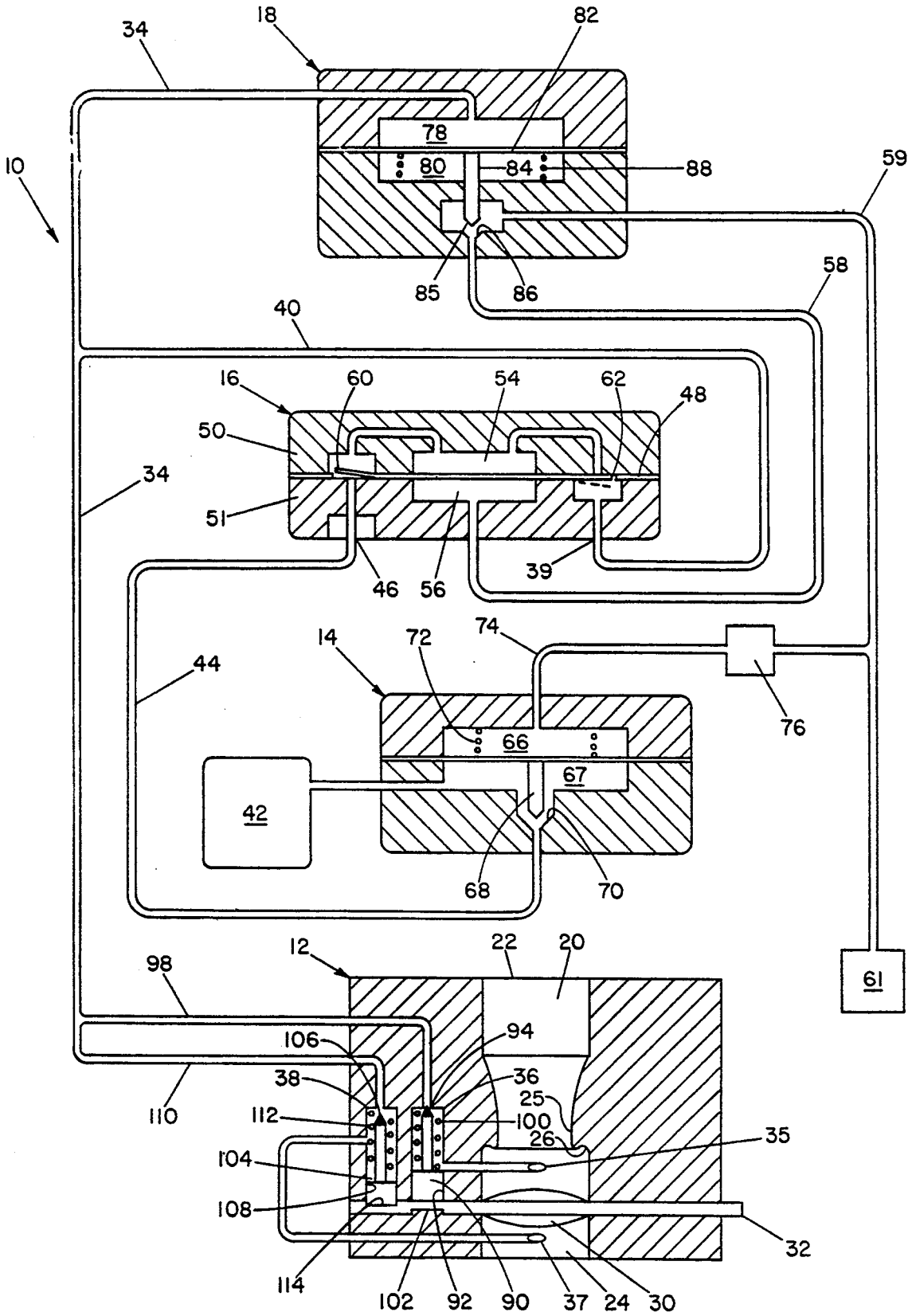
FIG. 1 is a diagrammatic view of a fuel supply system embodying the invention.

A closed loop carburetor and fuel supply system of the present invention is incorporated in a single housing 10 which in the drawings is represented by separate housing portions illustrating a carburetor section 12, a fuel shutoff valve 14, a pump 16 and a fuel pressure regulator 18.

The present invention is directed to two cycle engines of the type used with chain saws, for example, and must be capable of operation in all positions, including a fully inverted position.

Two cycle engines operate by drawing air and fuel through the carburetor section into the crankcase of the engine. During the compression stroke of the piston, a mixture of air and fuel is bled from the engine crankcase into the engine cylinder. The crankcase undergoes a change in pressure from sub-atmospheric or vacuum pressure to positive pressure above atmospheric pressure. These pressure fluctuations are utilized for operating the pump section 16 in the embodiment of the present invention.

The carburetor section 12 includes a bore 20 having an inlet opening 22 and an outlet opening 24. Between the openings 22 and 24 is a restricted venturi passage indicated at 25 The venturi passage is undercut as indicated at 26 to form an annular groove facing toward the outlet end 24 The bore 20 forms a fuel and air mixing passage by which air enters at the large opening 22 and is delivered to the open end 24 communicating with the intake manifold of the engine. The venturi passage 25 acts to create a low pressure effect during air flow due to the restriction of the venturi portion and the undercut 26 acts to restrict back flow of a mixture of air and fuel against the stream of incoming air which can be an undesirable characteristic, particularly at high operating speeds of the engine.

A conventional butterfly type of throttle valve 30 is mounted on a shaft 32 journaled in the walls of the housing portion 12 for movement between open and closed positions.

Fuel to the mixing passage formed by the bore 20 of the carburetor section 12 is delivered from pump 16 by way of main fuel conduit 34 to a fuel outlet 35 forming part of a high speed metering portion or section indicated at 36 and a fuel outlet 37 forming part of a low speed metering portion or section indicated at 38. The fuel conduit 34 is connected to the outlet 39 of pump 16 by way of a branch conduit 40. The pump 16 receives fuel from a tank 42 through the control or shut off valve 14 and a fuel conduit 44 connected to the inlet 46 of the pump 16.

The pump 16 is of the diaphragm type in which a diaphragm is sandwiched between housing portions 50 and 51. A portion of the diaphragm 48 is located in a cavity formed in the housing portions 50 and 51 and acts to divide the cavity into a fuel chamber 54 and a pumping chamber 56. The pumping chamber 56 is connected to a source of vacuum through the fuel pressure regulator 18 by way of a vacuum conduits 58 and 59. The vacuum source is the engine crankcase indicated at 61. Vacuum pressure pulsations within the crankcase 61 also are developed in the pumping chamber 56 of pump 16 This causes the diaphragm 48 to flex and pulse. The pump diaphragm 48 also has a flap forming an inlet valve 60 associated with the inlet 46 and a flap forming an outlet valve 62 associated with fuel conduit 39 communicating with branch line 40 and fuel delivery conduit 34. The flaps forming the inlet and outlet valves 60 and 62 are in a single unitary sheet of elastomeric material making up the diaphragm 48.

The inlet valve 60 controls the admission of fuel to the pump 16 from the line 44. As a result of pulsations of pressure in the pumping chamber 56, the diaphragm 48 flexes in one direction to draw fuel from the line 44 through the valve 60. Upon flexing of the diaphragm in the opposite direction, fuel is delivered through the outlet valve 62 to branch line 40 communicating with the fuel conduit 34 delivering fuel to the high and low speed metering circuits 36 and 38. When vacuum pressure, that is sub-atmospheric pressure, exists in the pumping chamber 56, the diaphragm 48 will flex downwardly from the position shown in the drawings causing a low pressure in the fuel chamber 54. This causes outlet valve 62 to close and inlet valve 60 to open to draw fuel from the tank 42. When the pressure in the pumping chamber 64 changes to a positive or super atmospheric pressure, the diaphragm 48 flexes upwardly increasing the pressure in the fuel chamber 54 causing the inlet flap valve 60 to close and at the same time to open outlet flap valve 62 so that fuel is delivered from the chamber 54 through branch line 40 to fuel conduit 34. As a result of the pumping action, the output pressure in the branch line 40 and fuel conduit 34 is to the order of one half to one psi which is sufficient to maintain the fuel delivery lines filled with fuel which is made available at the high speed and low speed circuits 36 and 38.

Fuel delivered by the pump 16 from the tank 42 is under the control of a shutoff valve 14. The shutoff valve 14 is formed in the main housing 10 and includes a diaphragm 64 sandwiched between housing portions and forming a vacuum chamber 66 above the diaphragm and a fuel chamber 67 below the diaphragm. The central portion of the diaphragm 64 is connected to a needle valve 68 adapted to move with the diaphragm between an open position and a closed position seated on a valve seat 70. The needle valve 68 normally is urged to a closed position by a spring 72 in chamber 66 acting on diaphragm 64. The vacuum chamber 66 is connected by a line 74 to vacuum conduit 59 communicating with the crankcase of the engine. The line 74 also contains a stabilizer valve 76. The stabilizer 76 is in the form of a one way check valve positioned to open in response to the vacuum portion of the pulsating pressure established in the crankcase 61 and conduit 59 to establish and maintain vacuum pressure in chamber 66. This serves to dampen the pulsating effect of the pumping vacuum in conduit 59. Any time the engine is rotating and creating a vacuum in the crankcase, the vacuum also is established in the chamber 66 which causes the diaphragm 64 to overcome the action of spring 72 and lift needle valve 68 from its seat 70 In the open condition of the valve the tank 42 is a communication with the inlet 46 of the pump 16. When the operation of the engine is stopped for any reason the vacuum of chamber 66 is terminated and the action of the spring 72 moves the needle valve to a closed position to stop communication between the fuel tank 42 and the pump 16 therefore stops delivery of fuel to the carburetor 12

The amount of fuel delivered to the carburetor 12 by the pump 16 is under control of the pressure regulator 18. The pressure regulator 18 is disposed in the housing 10 and is formed by a housing section which forms a cavity divided into chambers 78 and 80 by a diaphragm 82. The upper chamber 78 is connected to the fuel conduit 34 and is typically occupied or filled with fuel at delivery pressure A central portion of the diaphragm 82 is connected to a stem 84, the end of which forms a valve element 85 moveable between open and closed positions relative to a valve seat 86. The diaphragm 82 is urged upwardly by a spring 88 seated in chamber 80 The valve seat 86 normally is fully open when the engine is not operating. As soon as rotation of the engine begins, a vacuum is crated in chamber 80 which is made available through the open valve 85, 86 to the pumping chamber 56 of the pump 16. As the engine continues to operate, fuel pressure is developed in the branch line 40 and the fuel conduit 34 to be made available in the fuel chamber 78 in the fuel pressure regulator 18. The pressure of fuel in the chamber 78 determines the extent of movement of the valve stem 84 and the degree of valve opening. In this manner, the vacuum made available to operate the fuel pump 16 is modified in accordance with the fuel pressure being developed by the pump 16 so that only the amount of fuel being used by the engine is delivered from the pump. In other words, the vacuum level available to operate the pump 16 is modulated by regulator 18 in proportion to fuel pressure being delivered.

Fuel delivered by the pump 16 to the branch line 40 and fuel conduit 34 is distributed through the high speed and low speed metering circuits 36 and 38. The high speed metering circuit 36 includes a plunger 90 slidable in a bore 92 The plunger 90 as a stem, the end of which is formed with a conical rubber tip 94 that is engagable with a seat formed by an opening at the end of high speed fuel line 98 of the high speed metering circuit 36. The valve element formed by the tip 94 is urged toward an open position spaced from its seat by a spring 100. The lower end of the plunger 90 is seated on the surface of throttle shaft 32 As shown in the drawing, this is the closed position of the valve 94. An indentation or notch 102 is formed in the shaft 32 in circumferentially spaced relation to the surface on which the plunger 90 is seated as illustrated in the drawing. Upon opening the throttle valve 30 by rotating the shaft 32, plunger 90 moves into the notch 102 and the valve element 94 moves from its seat under the urging of spring 100, permitting the passage of fuel from the high speed metering conduit 98 passing the open valve element 94, and through a delivery conduit ending at the high speed outlet 35 in the venturi passage 24. When the throttle valve 30 is turned to a closed position the lower end of plunger 90 moves out of the indentation 102 and is seated on the outer surface of shaft 32 which raises plunger 90 against the action of spring 100 and returns the valve element 94 to its closed position. This prevents further delivery of fuel in the high speed metering system 36 to the outlet 35 in the venturi passage 24 upstream of the throttle valve 30.

The idle or low speed metering circuit 38 includes a plunger 104 having a stem with a rubber tip 106 forming a valve element similar to the valve element 94 used in association with the high speed metering circuit The plunger 104 is slidable mounted in a bore 108 and is continuously urged away from its seat formed at the end of fuel line 110 by a spring 112. In the open position of valve element 94, plunger 104 is seated in a notch 114 formed in the shaft 32. The arrangement of notches 102 and 114 causes valve element 94 to be closed when valve element 106 is open and vice versa.

In operation, the two cycle engine is started by rotation of its crankshaft which creates a vacuum, in the crank case that is immediately established in chamber 66 of shut-off valve 14 to overcome the action of spring 72 and open valve 68, 70 so that the fuel tank 42 is in full communication through the open valve and the line 44 to the inlet 46 of the pump 16 At the same time vacuum pressure is established in the conduits 59 and 58 to the chamber 56 of pump 16 so that pumping action can begin. Such pumping action draws fuel from the tank 42 and delivers it under pressure to the outlet 39 of the pump 16. From the outlet 39 fuel is made available through branch conduit 40 and fuel conduit 34 through the open low speed metering system 38. At this time the low speed metering valve 106 is open and the high speed metering valve 94, 92 is closed. Fuel, therefore, is delivered through the fuel outlet 37 downstream of the throttle valve 30 so that the engine can start ignition. The engine will operate at low speed until the throttle valve 30 is moved to a more fully opened position. The high speed valve element 94 will open and low speed valve 106 will close on their respective seats so that fuel is made available to the mixing passage 28 through the high speed fuel outlet 35 only. The engine will be rotating at a high rate of speed and the level of vacuum pressure will increase and be made available in the pumping chamber 56 to result in a higher fuel output of the pump 16. This fuel output also is made available in the fuel chamber 78 of the fuel pressure regulator 18 causing the diaphragm 82 to deflect against the action of spring 88 to move the valve stem 84 toward a closed position on the seat 86. The valve remains partially open but restricts the level of vacuum pressure made available in the vacuum conduit 58 from the line 59. This modulates the level of vacuum pressure available in the pumping chamber 56 and therefore the pumping action of the pump 16. As a consequence the output of fuel from the pump 16 is in proportion to the fuel being used in the passage 20 because the pumping action is being modulated in accordance with the requirements for fuel by the engine which is made available in the fuel pressure chamber 78.

If the throttle valve 30 should be moved from a fully open position to a fully closed position, the high speed circuit 36 is immediately closed due to the unseating of the plunger from the notch 102 and the simultaneous opening of the valve 106 to the low speed circuit. In this manner, the delivery of excess fuel is prevented and only the amount of fuel required by the engine is delivered through the delivery conduit 34.

If for any reason the engine should stop operating whether operating at high or low speed, the source of vacuum for operating the pump 16 will be eliminated but more importantly, valve 14 will immediately move to a closed position under the action of the spring 72 in chamber 66 so that fuel tank 42 is isolated from the fuel delivery system. From this it can be seen that only the amount of fuel required is delivered and as a consequence it is unnecessary to provide a return system for excess fuel to the tank 42. As a consequence, the present system is regarded as a closed loop system.

Moreover, the fuel delivery system may be regarded as a low pressure injection system in that the pressure of the fuel being delivered to the conduit 34 is to the order of one half to one psi.

A fuel supply system for a two cycle engine has been provided in which the delivery of fuel is proportional to the vacuum level resulting from crankshaft rotation during operation of the engine so that only the fuel being used is delivered making it unnecessary to provide a return loop to the fuel tank. Furthermore, both the high speed and low speed delivery circuits are under the control of a shutoff valve such that when engine operation stops for any reason, delivery of fuel to the high speed and low speed circuits also stops.

Figure 2:
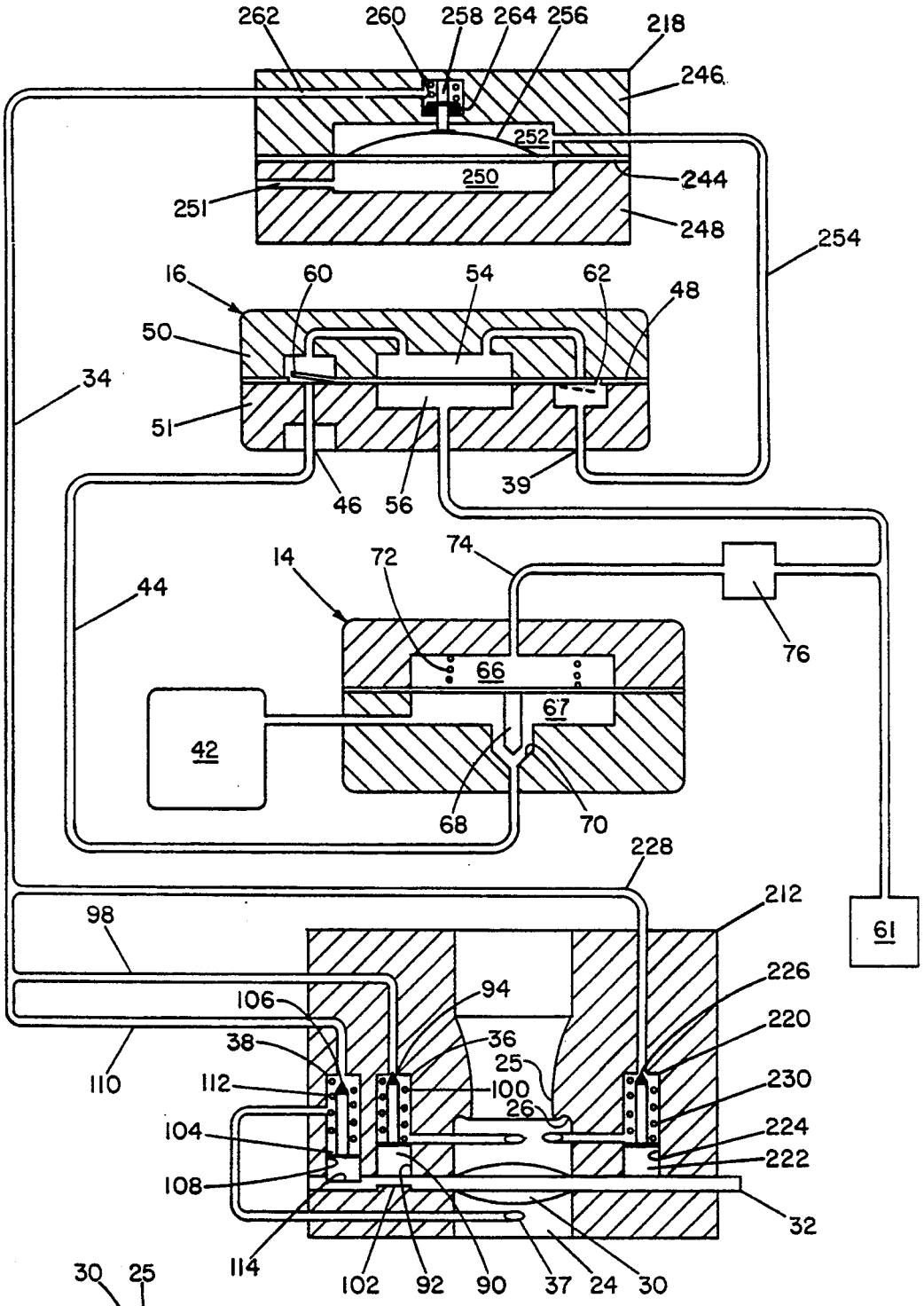
FIG. 2 is another diagrammatic view of another embodiment of the invention.

FIG. 2 illustrates another aspect of the invention. In this case, the close loop carburetor and fuel supply system is also incorporated in a single housing which in the drawings is represented by separate housing portions illustrating a carburetor section 212, a fuel shutoff valve 14 identical to that used in the first embodiment of the invention, a pump 16 also identical to that shown in FIG. 1 and a fuel pressure dampening arrangement 218.

Carburetor section 212 is identical in all respects to the arrangement shown in FIG. 1 except that the fuel distribution means in addition to a high speed metering section 36 and a low speed metering section 38, includes a midrange metering section 220. The midrange metering circuit 220 like the high and low speed circuits includes a plunger 222 slidable in a bore 224. Plunger 222 has a stem, the end of which is formed with a conical rubber tip 226 which is engageable with a seat formed by the opening at the end of the midrange fuel supply line 228 The plunger 222 is continuously urged away from the seat formed at the end of the fuel line 228 by a spring 230.

Figure 4:
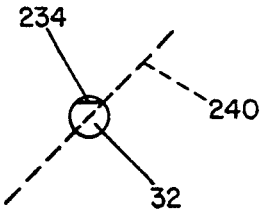
FIG. 4 is a diagrammatic view of the throttle valve, at an enlarged scale, illustrating one of its operating positions.

The midrange metering system 220 has a fuel outlet 232 opening to the venturi passage 24. In the closed position of the midrange metering valve 226, the lower end of the plunger 222 is seated on the surface of throttle valve shaft 32 as shown in FIG. 2. As seen in FIG. 4, an indentation or notch 234 is formed in the shaft 32 in spaced circumferential relation to the surface on which the plunger 222 is seated Upon rotation of the shaft 32, to position throttle valve 30 at dash line 240, the plunger 222 moves into the notch 234 and the valve element 26 moves from the seat under the urging of the spring 230 to permit the passage of fuel from the mid range metering conduit or line 228, through the open valve element 226 and through the outlet 230 into the venturi passage 24.

The opening and closing of the low speed metering valve 36, the high speed metering valve 38 and or mid range valve 226 are all controlled in response to rotation of the throttle valve 30 together with the shaft 32. Typically the throttle 30 moves about the axis of shaft 32 in arc of approximately seventy five degrees between its most fully closed position, illustrated in dot-dash lines at 236 in FIG. 3 and a fully opened position illustrated in full line at 238. In its closed position, the throttle valve 30 is at an angle of approximately 15 degrees to a plane transverse to the axis of the venturi passage 25. Similarly, rotation of the shaft 32 an additional seventy five degrees will move the trottle valve 30 to a fully open position as indicated at 238 in FIG. 3. The throttle valve 30 is regarded to be in its midrange position when it is at an angle of approximately forty five degrees as illustrated in dash lines at 240 in FIG. 3.

The three metering or shutoff valves 36, 38 and 226 are so arranged relative to the throttle valve shaft 32 that only one of the valves is open at any given time. In the closed position of the throttle valve 30 illustrated at 236, valves 36 and 226 are closed and fuel is delivered only through the outlet 37 positioned downstream from the throttle valve 30, when the throttle valve 30 is moved away from its almost closed position at 236 towards its midrange position indicated at 240, fuel flow through the outlets 35 and 37 is stopped and fuel outlet 230 is open to the delivery of fuel. Upon movement of the throttle valve 30 to its fully opened position illustrated at 238 in FIG. 3, outlets 37 and 230 seen in FIG. 2 are closed and the fuel outlet 35 is open.

The fuel pressure regulator 218 includes a diaphragm 244 clamped between a housing member 246 and 248. The diaphragm 244 forms a chamber 250 in the housing member 248 which communicates through vent 251 with the atmosphere. The other housing member 246 acts with the diaphragm 244 to form a chamber 252 which communicates with the outlet of the pump 39 by way of a fuel line 254. Disposed within the fuel chamber 252 is a dished metal plate 256 engaging the diaphragm 244 and connected to a stem 258 disposed in a bore 260. The upper end of bore 260 communicates by way of a passage 262 with the fuel line 34. An O-ring 264 is fitted in the bore 260 and acts as a valve element. Upon movement of the stem 258, fuel delivered to the fuel pressure chamber 252 causes the diaphragm 244 to deflect downwardly and corresponding movement of the O-ring opens the bore to the flow of fuel to the passage 262 and conduit 34 to the fuel metering system.

Fuel delivered from the pump 16 through the outlet 39 is in the form of pulsations due to the pulsations of the driving force of the pump Pressure regulator 218 serves to dampen the fluctuations in fuel pressure so that a reasonable steady stream of fuel is delivered to the passage 262. Such pressure is further dependent on the speed at which the engine is operating.

Figure 3:
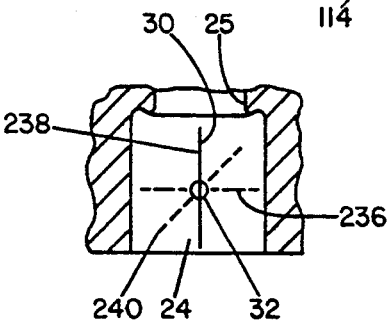
FIG. 3 is a diagrammatic view illustrating different positions of the throttle valve.

In operation of the embodiment of the invention shown in FIGS. 2 and 3, the two cycle engine is started by rotation of its crankshaft to create a vacuum in the crankcase indicated at 61. This is immediately established in chamber 66 to open the shutoff valve 14 so that fuel can be delivered from the fuel tank 42 through chamber 67 and line 44 to the pump inlet 46. At the same time, vacuum pressure is established in the conduit 59 communication with the pump chamber 56 so that pumping action begins. Fuel is delivered from the pump outlet 39 to the pressure regulator 218 which dampens the pulsations of fuel and delivers the fuel from the passage 262 to the line 34 through the open low speed valve 106 of the metering system. At this time the high speed valve 94 and the midrange valve 226 are closed. As a result, fuel is delivered through the fuel outlet 37 downstream of the throttle valve 30 so that the engine can start ignition.

The engine will operate at low speed until the throttle valve is moved from the idle position indicated at 236 in FIG. 3 to a more fully opened position such as the midrange position at indicated in 240 in FIG. 3 When the valve 30 attains its midrange position 240 the low speed valve 106 and high speed valve 94 will be closed The engine will be rotating at a higher rate of speed causing the vacuum pulsations to increase in the pumping chamber 56 and result in a higher fuel output from the pump 16. This fuel is delivered to the regulator 218 which serves to dampen the fuel pulsations and deliver fuel to the line 34.

The engine will operate at its midrange speed until the throttle valve 30 is moved from its intermediate position at 240 in FIG. 3 to a fully opened position illustrated at 238. In that position the high speed valve 94 will be opened and the low speed valve 106 and midrange speed valve 226 will be closed. At this point the engine will rotate at its maximum rate of speed and the level of vacuum pressure will increase proportionately and be made available in the pumping chamber to result in a higher fuel output of the pump 16. This output also is dampened by the pressure regulator 218 and delivered to line 34.

Upon moving the throttle valve 30 from a fully opened position to a fully closed position, the high speed fuel valve 94 and the midrange fuel valve 226 are immediately closed and the low speed valve 106 is open. In this manner the delivery of excess fuel is prevented and only the amount of fuel required by the engine is delivered through the delivery conduit 34.

The advantage of the embodiment of the invention shown in FIG. 2 is that the entire fuel output curve between low and high speed is controlled as opposed to only the low and high speed end of the range. When only the low and high speed ranges are controlled, midrange operation is regarded as satisfactory because usually more fuel is being delivered than is required. By controlling the midrange, delivery of excess fuel is prevented and only enough fuel to operate at the midrange speeds is delivered. This prevents waste of fuel and the accompanying excessive emissions.

The carburetor section 212 with its three separate shut off valves can also be substituted for the carburetor 12 in the FIG. 1 system in which case the advantages of the three valve control will be obtained to further minimize the delivery of excessive fuel to the engine.

In this embodiment of the invention shown in FIG. 2 the fuel supply system for a two cycle engine is provided in which delivery of fuel is dampened to afford a relatively uniform pressure and additionally the flow of fuel is controlled throughout the entire range between low and high speed to prevent the use of excessive fuel. Only the fuel necessary is delivered to the engine making it unnecessary to provide a return loop to the fuel tank

I claim:

1. A closed loop fuel system for supplying fuel to an engine in all of its positions including an inverted position, comprising:

a housing having mixing passage for supplying a mixture of fuel and air to the engine, a throttle valve in said mixing passage for controlling the supply of fuel and air mixture to the engine, a pump operative in response to vacuum pulsations in the crankcase of the engine and having a fuel inlet for receiving fuel and a fuel outlet for delivering fuel, fuel distribution means receiving fuel from said pumps and delivering fuel to said mixing passage, said distribution means including a first fuel passage communicating with said mixing passage downstream of said throttle valve and second and third fuel passages communicating with said mixing passage upstream of said throttle valve, and shutoff valves controlling each of said passages and being actuated between open and closed position in response to the position of said throttle valve, each of said valves being in an open position when the other of said valves are closed.

2. The fuel system of claim 1 wherein said first fuel passage is open when said throttle valve is in its open position.

3. The fuel system of claim 1 wherein said second fuel passage is open when said throttle valve is in its open position.

4. The fuel system of claim 1 wherein said third fuel passage is open when said throttle valve is in an intermediate position between open and closed.

5. The fuel system of claim 1 and further comprising fuel dampening means between said fuel pump and said fuel distribution means.

6.The fuel system of claim 1 and further comprising means to stop delivery of fuel to said fuel distribution means in response to interruption of rotation of the engine.

7. The fuel system of claim 6 wherein said means to stop delivery of fuel includes a normally closed valve responsive to the vacuum developed in said engine crankcase when the engine is rotating to hold said valve in an open position.

8. The fuel system of claim 1 wherein said throttle valve is rotatable between open and closed positions on an axis transverse to said mixing passage.

9. The fuel system of claim 8 and further comprising cam means connected to said throttle valve and being rotatable on said axis and engageable with said shutoff valves to actuate the latter.

10. The fuel system of claim 1 and further comprising fuel pressure regulating means responsive to the level of pressure of fuel delivered by said pump to regulate the level of vacuum delivered from said crankcase to drive the pump and thereby regulate the output pressure of fuel delivered from said pump to said fuel distribution means.

11. The fuel system of claim 10 wherein said fuel pressure regulating means includes a vacuum valve between said crankcase and said pump movable between open and closed positions in response to the level of fuel pressure delivered by said pump.

* * * * *